US007487880B2

(12) United States Patent
Guarrascio

(10) Patent No.: US 7,487,880 B2
(45) Date of Patent: Feb. 10, 2009

(54) FOOD CONTAINER

(76) Inventor: Bernard Guarrascio, 7 Jodi La., New City, NY (US) 10956

( * ) Notice: Subject to any disclaimer, the term of this patent is extended or adjusted under 35 U.S.C. 154(b) by 688 days.

(21) Appl. No.: 11/231,961

(22) Filed: Sep. 21, 2005

(65) Prior Publication Data

US 2006/0060579 A1 Mar. 23, 2006

Related U.S. Application Data

(60) Provisional application No. 60/611,640, filed on Sep. 21, 2004.

(51) Int. Cl.
*B65D 51/16* (2006.01)

(52) U.S. Cl. ..... 220/367.1; 220/745

(58) Field of Classification Search ..... None
See application file for complete search history.

(56) References Cited

U.S. PATENT DOCUMENTS 5,662,237 A * 9/1997 Cain ..... 220/368
6,257,434 B1 * 7/2001 Lizzio ..... 220/4.23
2005/0000966 A1 * 1/2005 Nordland et al. ..... 220/367.1

* cited by examiner

*Primary Examiner*—Stephen Castellano

(57) ABSTRACT

Substantially similar upper and lower container sections are shaped to cooperate and define an enclosure for receiving the food item, such as a pizza pie, to be delivered in the container. Each of these sections is formed of a substantially square panel, defining a base plane and having four lateral edges of substantially equal length and four corners, as well as depending sidewalls formed integrally with the panel and extending along its lateral edges at an angle with respect to the base plane. Each sidewall is of substantially constant width along the length of the edge. The food item is maintained in a fresh condition by providing a "chimney" at each of the four corners of the container for passage of vapors (e.g., steam) from the inside of the container to the outside. Each chimney has at least one vent, allowing vapors to enter the chimney "flue" from the container and dissipate to the atmosphere when the vapor pressure inside the container exceeds a certain threshold above the atmospheric pressure.

17 Claims, 13 Drawing Sheets

FOOD CONTAINER

CROSS REFERENCE TO RELATED APPLICATION

The present application claims benefit of priority from U.S. Provisional Application Ser. No. 60/611,640, filed Sep. 21, 2004, entitled "TWO PIECE OR CLAMSHELL PACKAGING BOX, E.G. FOR PIZZA".

BACKGROUND OF THE INVENTION

The present invention relates to a disposable food delivery container and, more particularly, to a container commonly known as a "pizza box".

Food containers, such as pizza boxes, are very well known. The purpose of the container is to receive a food item, such as a pizza pie, which has just been prepared for consumption; e.g., oven baked, and to hold it for an extended period of time in its original condition in such a way that its freshness and taste are, to the greatest extent possible, retained.

Numerous food containers of this type have been devised and patented. Set forth below is a list of the most relevant patents known to applicant.

U.S. Pat. No. 4,058,214
U.S. Pat. No. 4,476,989
U.S. Pat. No. 4,804,137
U.S. Pat. No. 4,848,543
U.S. Pat. No. 5,273,174
U.S. Pat. No. 5,385,292
U.S. Pat. No. 5,423,477
U.S. Pat. No. 5,472,139
U.S. Pat. No. 5,605,231
U.S. Pat. No. 5,662,237
U.S. Pat. No. 5,725,146
U.S. Pat. No. 5,806,755
U.S. Pat. No. 5,833,130
U.S. Pat. No. 6,095,324
U.S. Pat. No. 6,196,448
U.S. Pat. No. 6,748,722
U.S. Patent Application Publication No. U.S. 2001/0000561

All of these prior art containers comprise substantially similar upper and lower container sections which are shaped to cooperate and define an enclosure for receiving the food item to be delivered in the container. Usually these sections are formed of a substantially square panel, defining a base plane and having four lateral edges of substantially equal length and four corners, as well as depending sidewalls formed integrally with the panel and extending along its lateral edges at an angle with respect to the base plane. Each sidewall is of substantially constant width along the length of the edge.

In a common embodiment of the food delivery container known in the art, the sidewalls of the upper container section interleave, either inside or outside, with the sidewalls of the lower container section, when the two container sections are mated together with a food item inside. In another common embodiment of the food delivery container, the four sidewalls of each container section define a plane of attachment to the other corresponding container section, with the sidewalls adapted to mate with the corresponding sidewalls of the other container section at the plane of attachment. Such an arrangement is known, for example, from the aforementioned U.S. Pat. No. 5,662,237. It is also known, in a round configuration, from the U.S. Pat. Nos. 5,273,174 and 5,605,231.

SUMMARY OF THE INVENTION

It is a principal object of the present invention to provide a disposable food delivery container of the type described above which is capable of holding a food item, such as a pizza pie, for an extended period of time in a relatively fresh condition.

This object, as well as other objects which will become apparent from the discussion that follows, are achieved, in accordance with the present invention, by providing at least one "chimney" formed integrally with the panel in each of the two square sections and extending outward from the base plane to the plane of attachment. A chimney is arranged adjacent each of the four corners of the panel and is adapted to mate with a corresponding chimney of the other container section at the plane of attachment. This chimney forms a "flue" for the passage of vapors from the inside of the container to the outside thereof and has at least one vent for allowing vapors to enter the flue from the container and dissipate to the atmosphere when the vapor pressure inside the container exceeds a certain threshold above the atmospheric pressure.

The four chimneys according to the present invention thus allow steam and condensation to escape from the container. When hot condensation occurs, it causes the vents to open, releasing the vapors from the heated food (e.g., pizza) within the container. In the case of pizza, this release of vapors occurs when the temperature of the pizza is greater than about 185° F. The vent or vents within the chimneys are preferably formed as a "flap valve". In the preferred embodiment, the flap valve is formed of a circular membrane, supported at its periphery, which has a plurality of cuts extending from its center to its periphery. For example, the vent may include six cuts spaced equidistantly apart and forming a 60° angle between them.

In this way, as the inside temperature of the container gradually decreases, the vents return to their closed position to maintain the inside elevated temperature for a prolonged period of time. As a result, the food item (e.g., pizza) stays fresher and crispier, due to the release of condensation, while staying hot.

Preferably, the chimneys of one container section include means for connecting themselves with corresponding chimneys of the other container section so that, when the two sections are placed together in mating relationship, the chimneys assist in holding the two container sections together, while allowing vapors to pass between the mating chimneys.

In a preferred feature of the invention, the sidewalls of the two container sections are provided with additional means for connecting one section with the other, when the two sections are in mating relationship.

In still another preferred feature of the invention, the bottom panel of at least one of the sections is corrugated or "fluted" with a wavelike form that keeps the contents of the container, e.g., pizza, elevated and removed from the influence of the outside surface that supports the container. The inside grooves between the ridges of the corrugations let moisture and other vapors escape from the bottom of the food item. As such, the corrugations facilitate the free passage of the vapors from the bottom of the food item to the chimney vents.

The corrugations may be designed, for example, as parallel straight lines, alternative convex and concave dimples or concentric circles with radially extending passages for the escape of vapors.

According to still another preferred feature of the present invention, the container may include an insert section formed of a substantially square panel with four lateral edges each substantially equal in length to the lateral edges of the two container sections. This insert section can be inserted between the two container sections at their plane of attachment to divide the container into two compartments, top and bottom, on either side of the insert section. In this way, two separate food items, e.g., two pizza pies, may be enclosed in the container.

Advantageously, the insert section is also corrugated to provide ventilation to the food item resting upon it.

In a further preferred feature of the present invention, the insert section may include a downwardly depending spindle, disposed at approximately the center thereof, for supporting the insert section at its middle when a food item is placed on it. The spindle may assume any shape but is preferably cone-shaped with its apex pointing downward.

The two container sections which, when mated together, form the container may be formed separately or, in accordance with a second preferred embodiment of the invention, integrally connected together along one sidewall at the plane of attachment. In the latter case, the container sections form a "clamshell" like arrangement which can be closed and thereafter opened without separating the two sections.

In any case, whether the container sections be independent or connected together to form the "clamshell", the sections are preferably "nestable", with one immediately adjacent (on top of) the other for ease of storage and transportation.

The sections of the container, as well as the insert, may be made of any suitable material which is light, non-toxic and sufficiently rigid to maintain its shape. Preferred materials are molded pulp paper, foamed or unfoamed plastic, such as polystyrene, and polyehylene.

DESCRIPTION OF THE PREFERRED EMBODIMENTS

Figure 1:
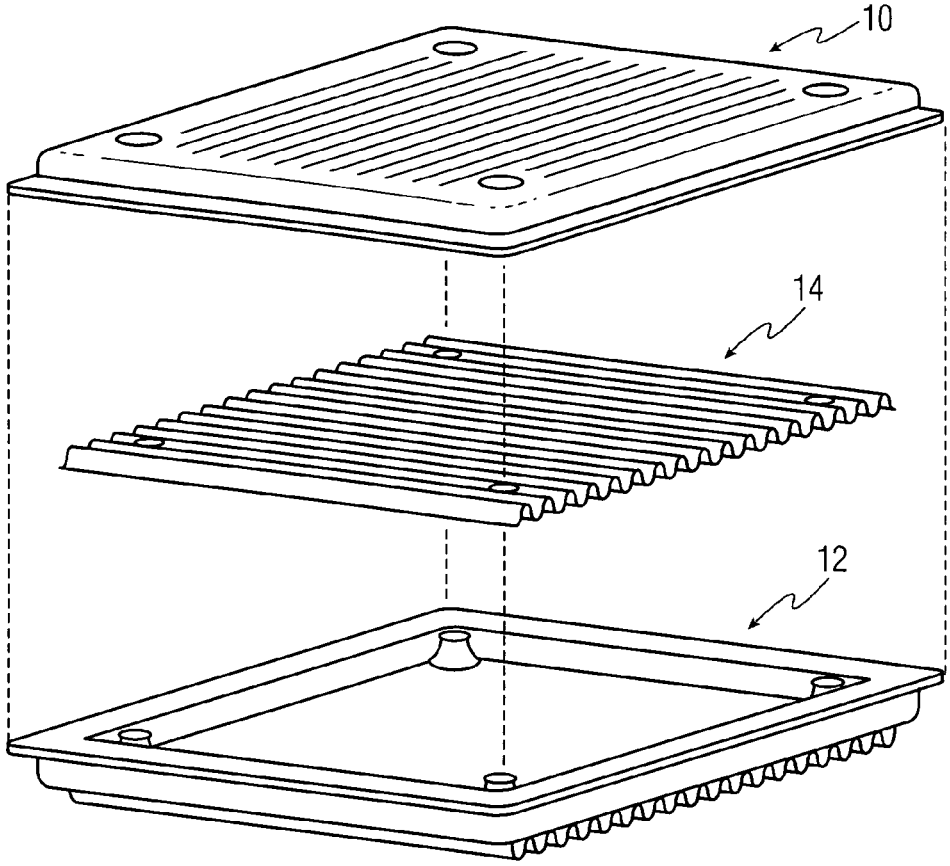
FIG. 1 is a perspective view of a food container, according to a first preferred embodiment of the present invention, which comprises a top section and a bottom section, with an insert section therebetween.
Figure 2:
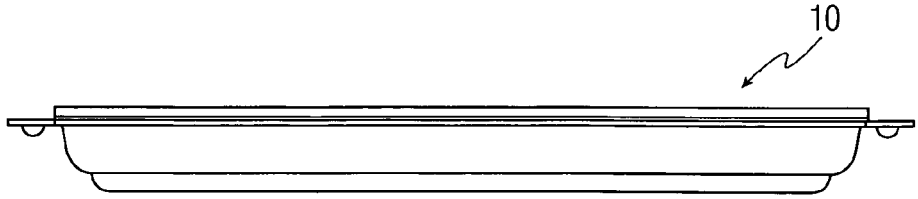
FIG. 2 is a side elevational view of the top section of the food container of FIG. 1.
Figure 3:
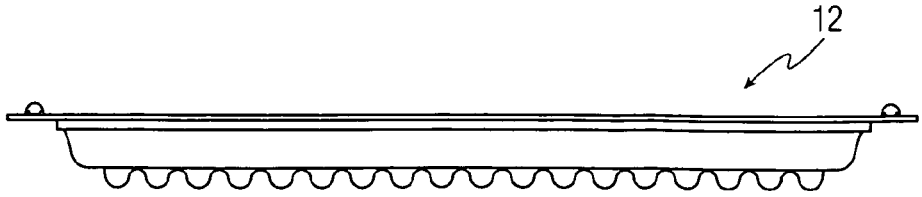
FIG. 3 is a side elevational view of the bottom section of the food container of FIG. 1.

The preferred embodiments of the present invention will now be described with reference to FIGS. 1-29 of the drawings. Identical elements shown in the various figures are identified with the same reference numerals.

Figure 18:
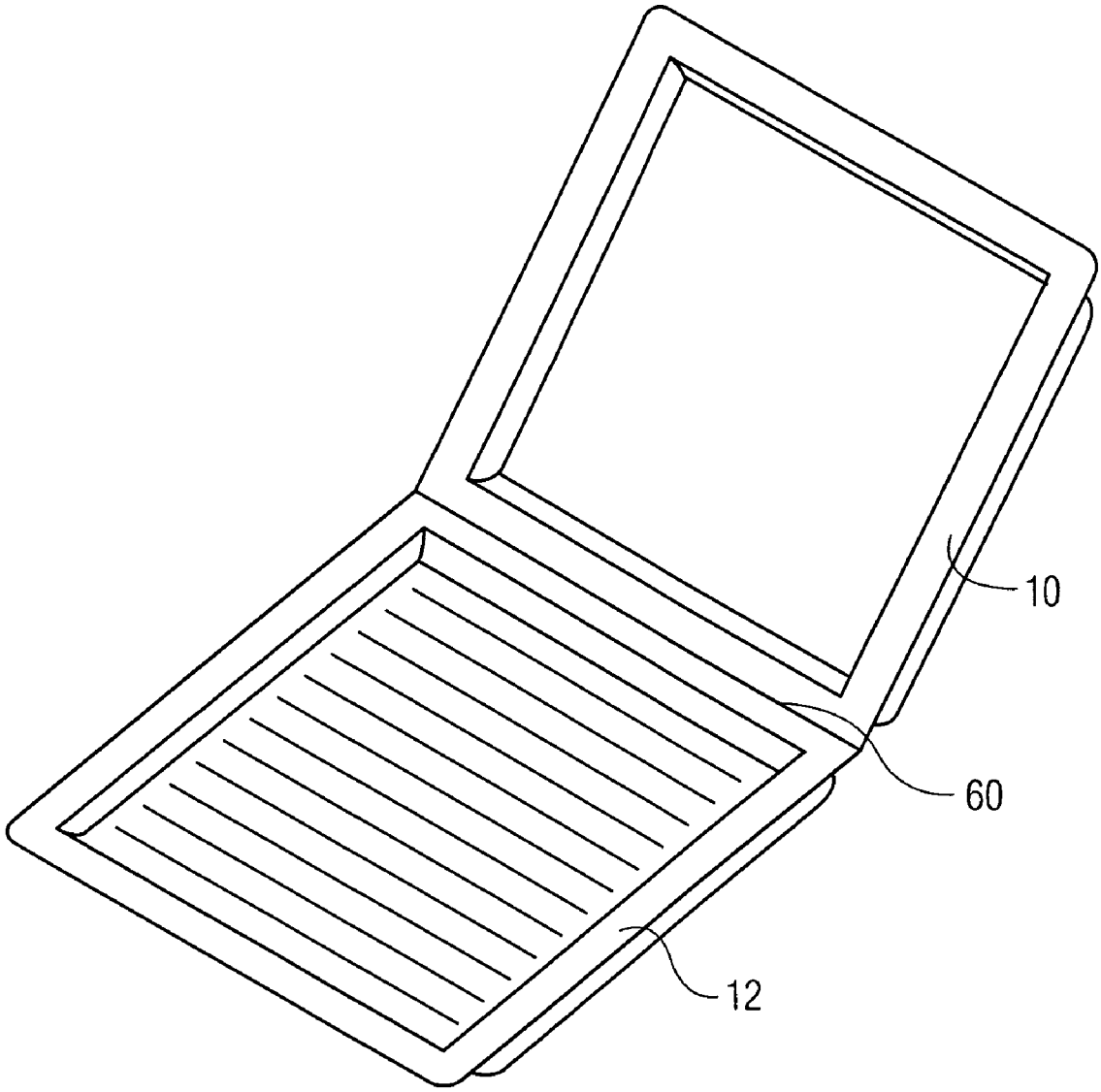
FIG. 18 is a perspective view of a food container according to a second preferred embodiment of the present invention in which the container comprises a top section and a bottom section hinged together along one side.
Figure 19:
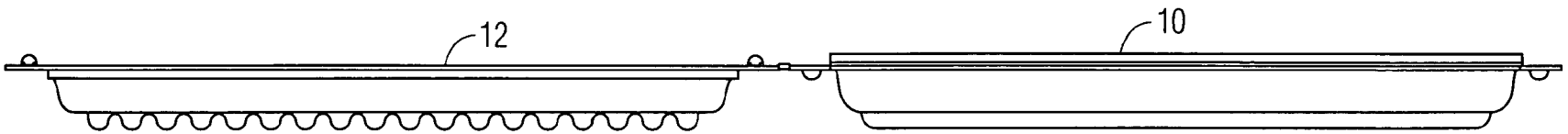
FIG. 19 is a side elevational view of the food container of FIG. 18 in the open configuration.
Figure 20:
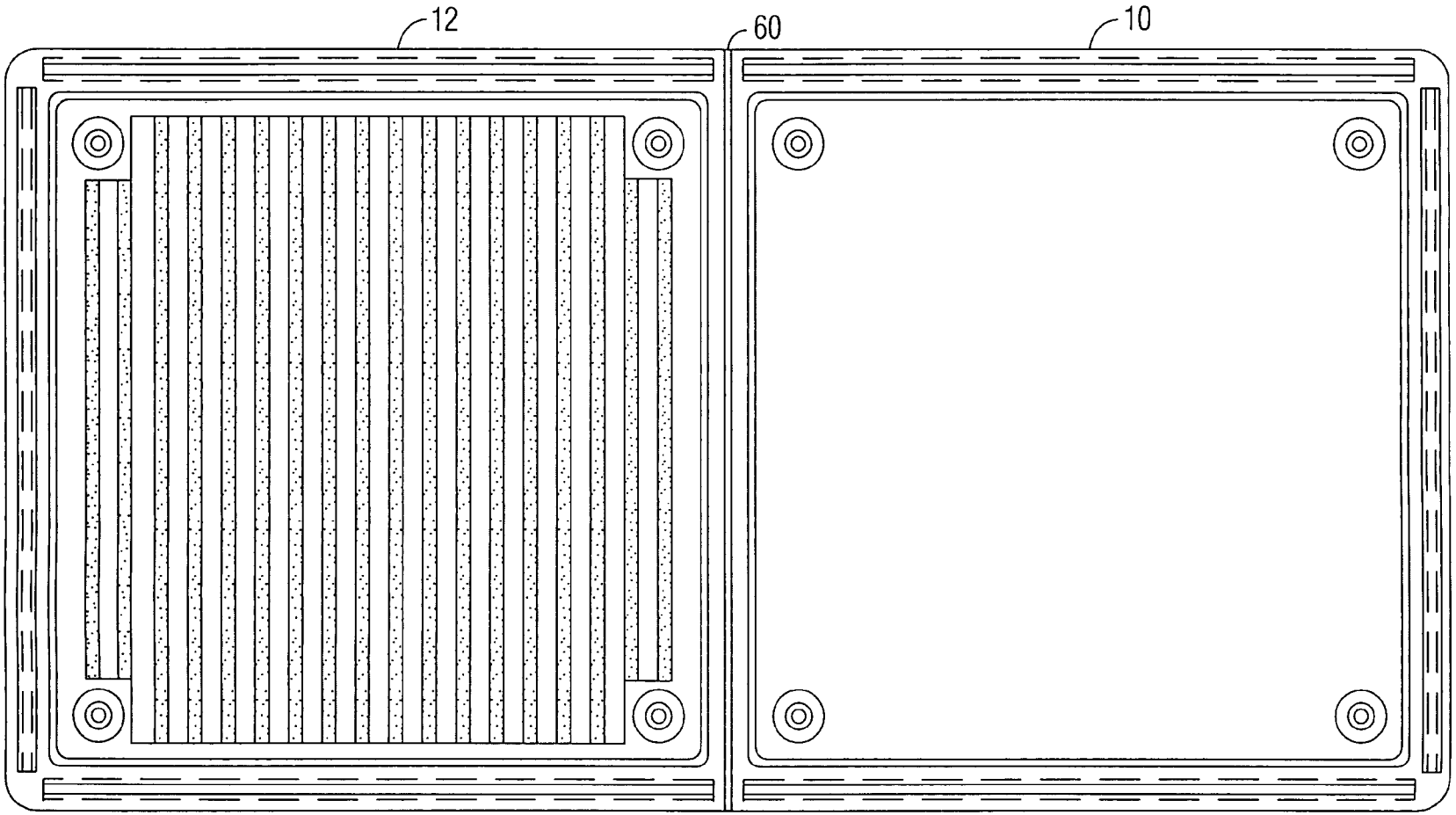
FIG. 20 is a top view of the food container of FIGS. 18 and 19.
Figure 21:
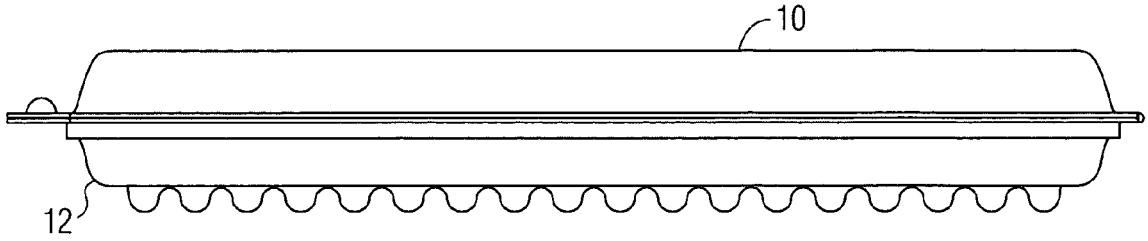
FIG. 21 is a side elevational view of the food container of FIG. 18 with the top section closed upon the bottom section.
Figure 22:
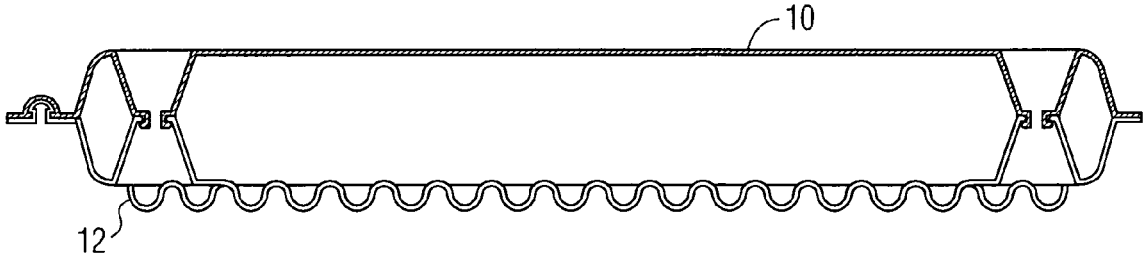
FIG. 22 is a cross-sectional view of the food container of FIG. 18 in the closed configuration.
Figure 23:
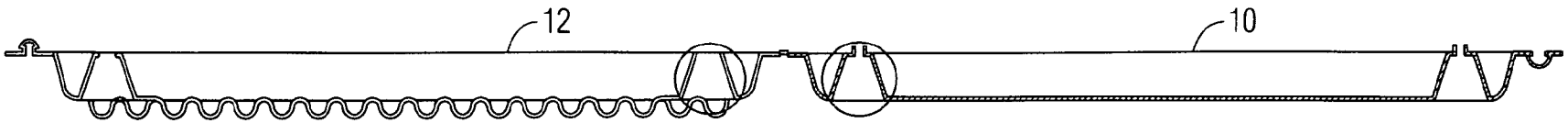
FIG. 23 is a cross-sectional view of the food container of FIG. 18 in the open configuration.
Figure 24:
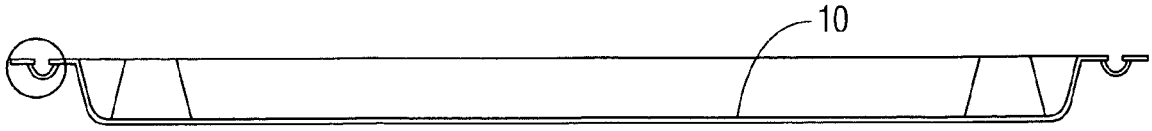
FIG. 24 is a transverse cross-sectional view of the top section of the food container of FIG. 18.
Figure 25:
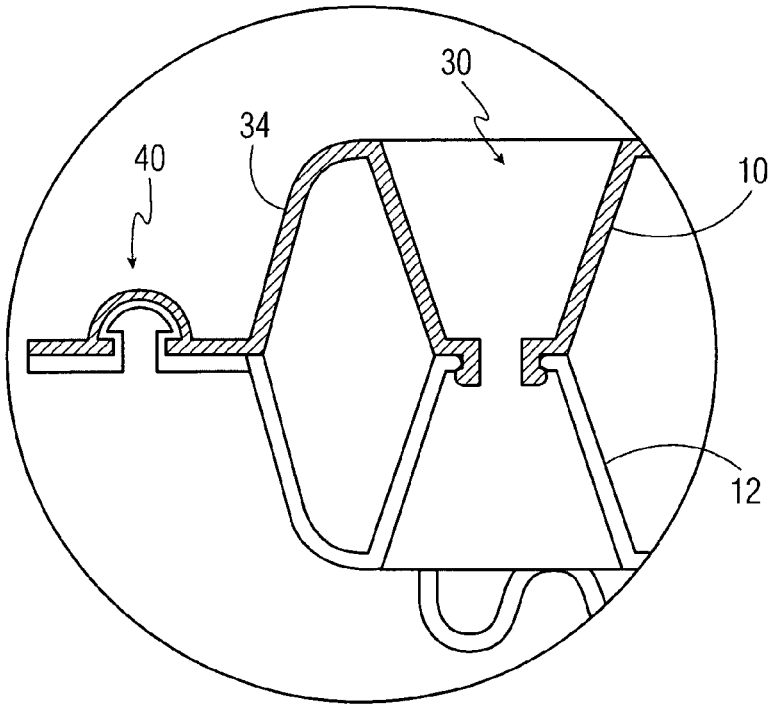
FIG. 25 is a cross-sectional view of the food container of FIG. 18, showing a chimney and a mushroom interlock in the closed condition in detail.
Figure 26:
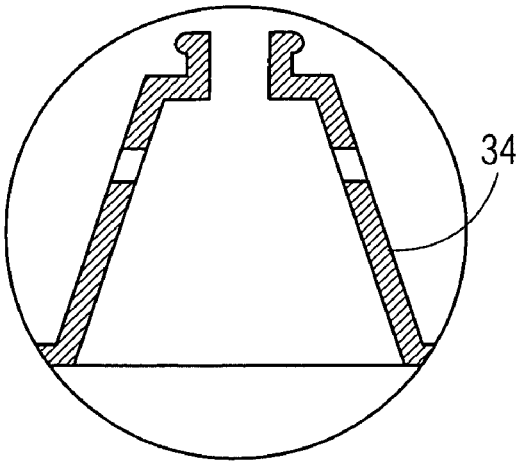
FIG. 26 is a cross-sectional view showing a chimney on the top section of the food container of FIG. 18 in detail.
Figure 27:
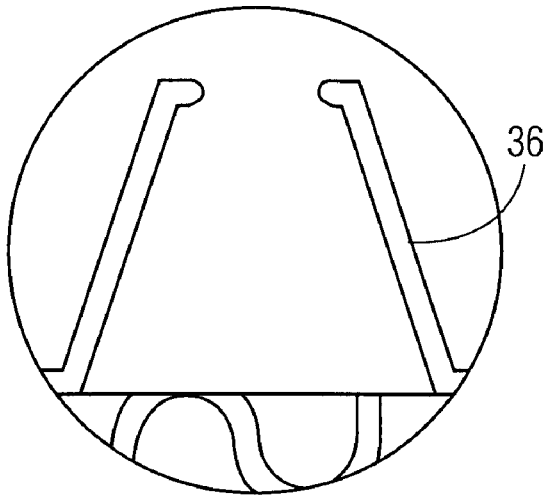
FIG. 27 is a cross-sectional view showing a chimney on the bottom section of the food container of FIG. 18 in detail.
Figure 28:
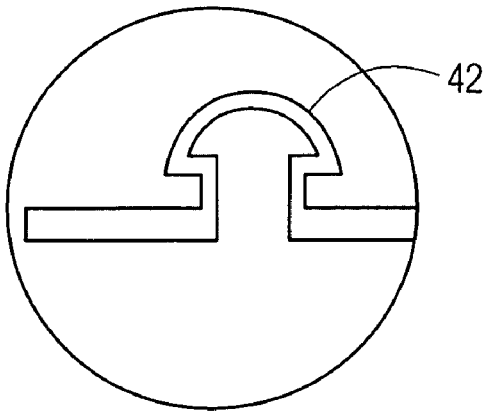
FIG. 28 is a cross-sectional view showing the mushroom interlock on the bottom section of the food container of FIG. 18 in detail.
Figure 29:
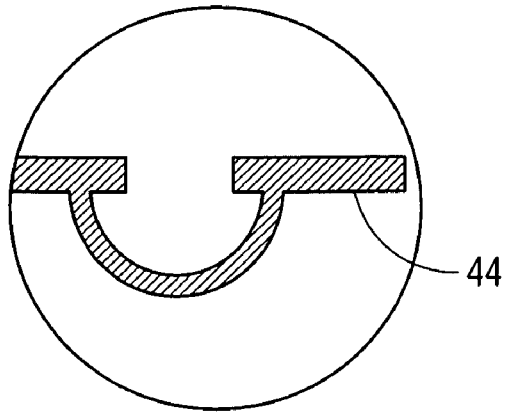
FIG. 29 is a cross-sectional view showing the mushroom interlock on the top section of the food container of FIG. 18 in detail.

FIGS. 1 and 18 show generally a first and a second preferred embodiment, respectively, of the food container according to the present invention. In both embodiments, the food container is illustrated as a "pizza box"; i.e. a box for holding one or two pizza pies.

In the first embodiment, shown in FIG. 1, a two-piece pizza box is formed by mating together a top section 10 and a bottom section 12. If desired, an insert section 14 may be inserted between the top and bottom sections to form two chambers, an upper chamber and lower chamber, when the pizza box is closed, making it possible to hold and carry two pizza pies within the box. Otherwise, the insert section 14 may be omitted and the box, with a single chamber, may hold and carry only a single pizza pie.

Both the top section 10 and bottom section 12 of the pizza box are preferably identical. Such identical elements simplify manufacturing and facilitate nesting of the sections for transportation and storage. Each section is formed of a substantially square panel, element 16 in the case of the top section and element 18 in the case of the bottom section, which is substantially square and has four lateral edges of substantially equal length and four corners. The panel, 16 or 18, defines a "base plane" indicated at 20 in FIGS. 6 and 22 in FIG. 7. Each section, 10 and 12, is provided with sidewalls indicated as 24 on the bottom section and 26 on the top section, respectively, formed integrally with the panel 16, 18 and extending along each lateral edge at an angle with respect to the base plane 20, 22. Each sidewall is of substantially constant width and defines, together with the three other sidewalls, a plane of attachment 28 to the other, mating container section. As such, the sidewalls are adapted to mate with the corresponding sidewalls of the other container section at the plane of attachment 28.

As shown particularly in FIG. 1, the top section, which in the preferred embodiment is identical to the bottom section, must be rotated 90° about the plane of attachment with respect to the bottom section prior to its attachment to the bottom section.

According to the invention, the top section and bottom section of the pizza box are each provided with four "chimneys" located at each corner of the substantially square section.

Figure 9:
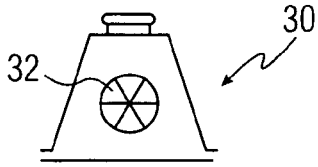
FIG. 9 is a side elevational view of a chimney provided on both the top and bottom sections of the food container of FIG. 1.

Each chimney 30 includes a vent or flap valve covering an opening 32, as illustrated in FIG. 9, which allows vapors within a closed container to enter a "flue" of the chimney and dissipate to the atmosphere when the vapor pressure inside the container exceeds a certain threshold above the atmospheric pressure. In the case of pizza, the flap valve may release vapors such as steam when the temperature of the pizza is greater than about 185° F. As may be seen in FIG. 9, the valve is formed of a circular membrane, supported at its periphery, which has a plurality of cuts extending from its center to its periphery. In this embodiment, the valve includes six cuts spaced equidistantly apart and forming a 60° angle between them which opens when sufficient pressure is applied to one side.

Figure 11:
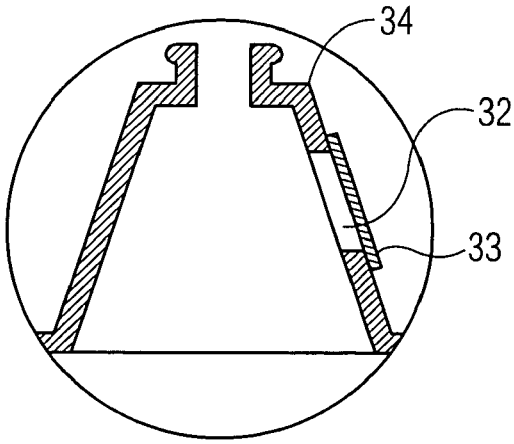
FIG. 11 is a cross-sectional view of a chimney provided on the top section of the food container of FIG. 1.
Figure 12:
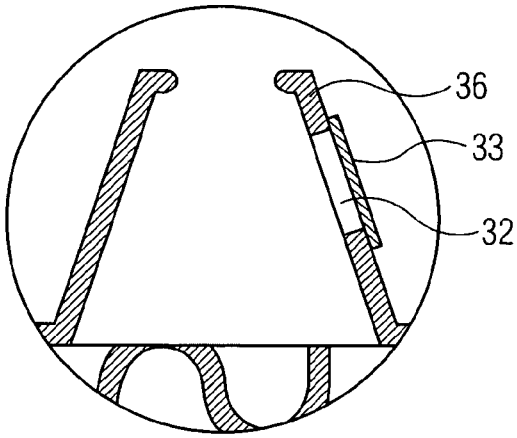
FIG. 12 is a cross-sectional view of a chimney provided on the bottom section of the food container of FIG. 1.
Figure 13:
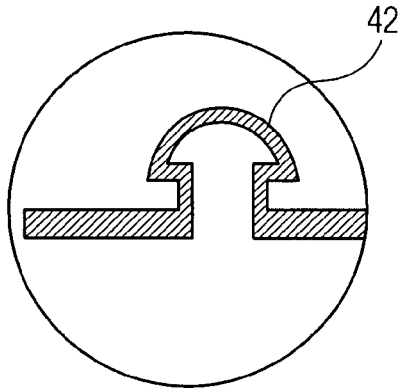
FIG. 13 is a cross-sectional view of a mushroom type interlock provided on the bottom section of the food container of FIG. 1.
Figure 14:
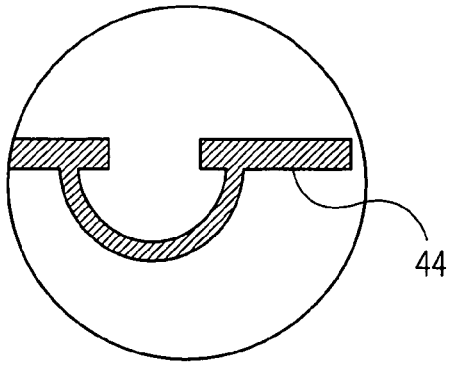
FIG. 14 is a cross-sectional view of an interlock provided on the top section of the food container of FIG. 1.

FIGS. 11 and 12 show cross sections the chimneys of the top and bottom container sections, respectively. As may be seen, the chimneys each have an opening 32 which is covered by a thin film or membrane 33, attached by an adhesive or the like on one side of the chimney flue. The membrane, which may be of polystyrene, for example, is cut in the manner shown in FIG. 9 to form the flap valve.

If the material forming the container sections 10 and 12 is, of itself, thin enough, a separate membrane 33 is not necessary and the cuts can be made directly on the chimney flue to form the flap valve.

Figure 10:
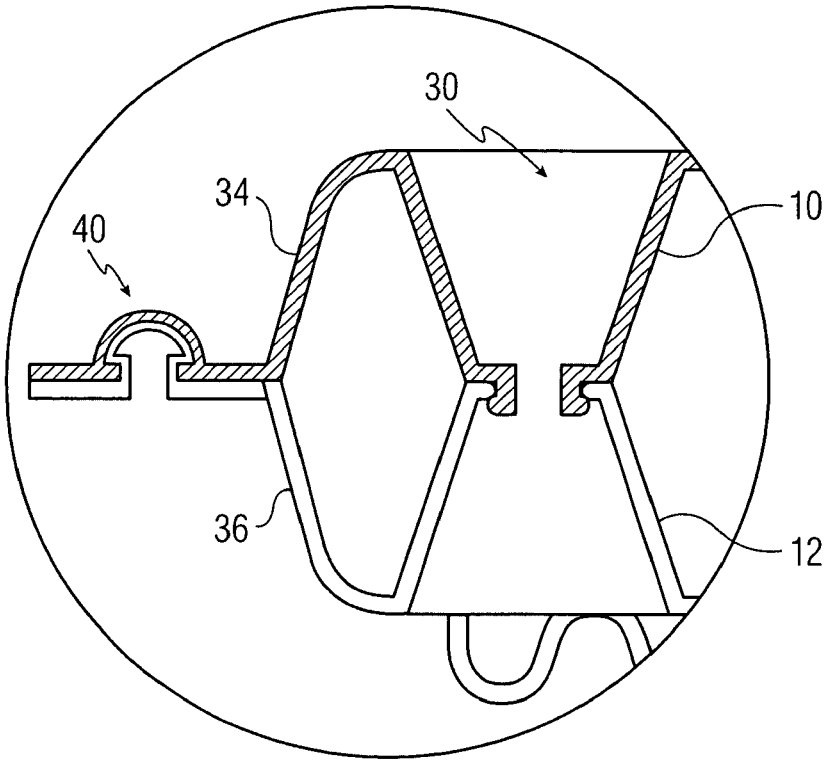
FIG. 10 is a cross-sectional view of two chimneys interlocked together, one from the top section and one from the bottom section of the food container of FIG. 1.

The chimneys of one container section include means for connecting themselves with corresponding chimneys of the other container section so that, when the two sections are placed together in mating relationship, the chimneys assist in holding the two container sections together, while allowing vapors to pass between the mating chimneys. These interlocking chimneys are best illustrated in FIG. 10 which shows a chimney of the top section of the container, illustrated in FIG. 11, interlocked with a chimney of the bottom section of the container, illustrated in FIG. 12.

In order to insure an airtight seal between the top section and bottom section of the container when it is closed, the sidewalls of the top and bottom sections are provided with elongate mushroom-type connectors 40 along their lateral edges. These connectors, which comprise a mushroom-shaped (in cross section) strip 42 extending upward from the bottom section, and a mating receptacle 44 on the top section, are best illustrated in FIG. 10 and in FIGS. 13 and 14.

Figure 4:
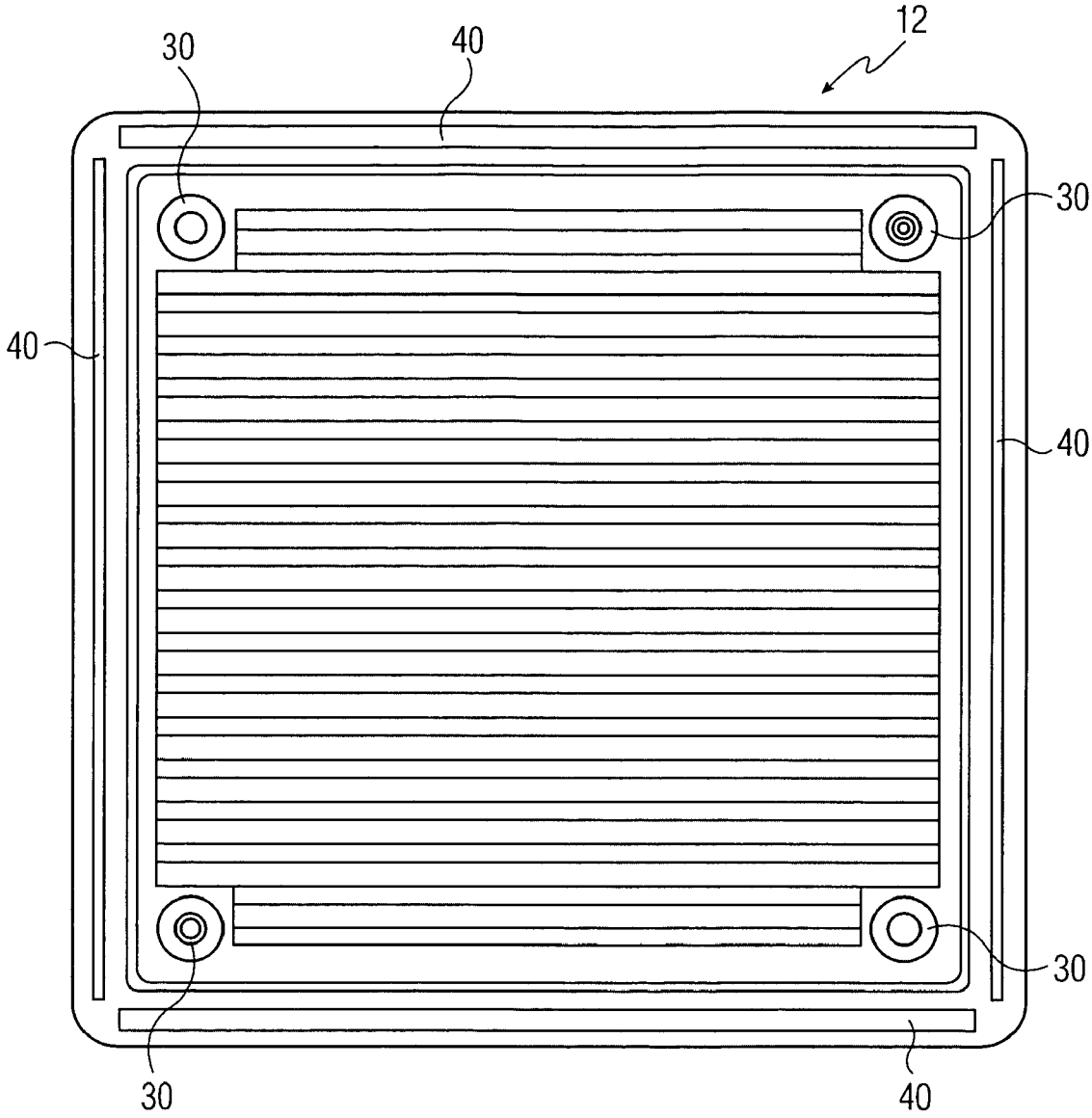
FIG. 4 is a top view of the bottom section of the food container of FIG. 1.
Figure 5:
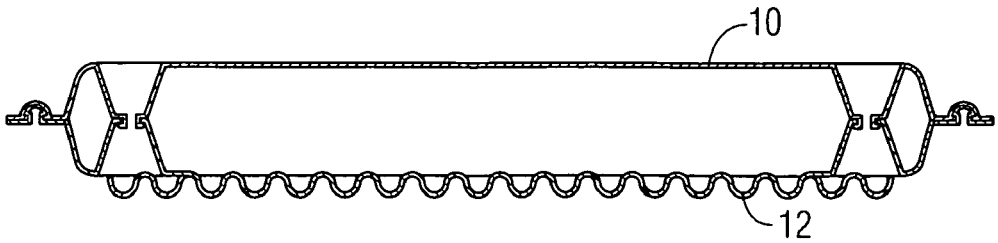
FIG. 5 is a cross-sectional view of the food container of FIG. 1 in the closed configuration.
Figure 6:
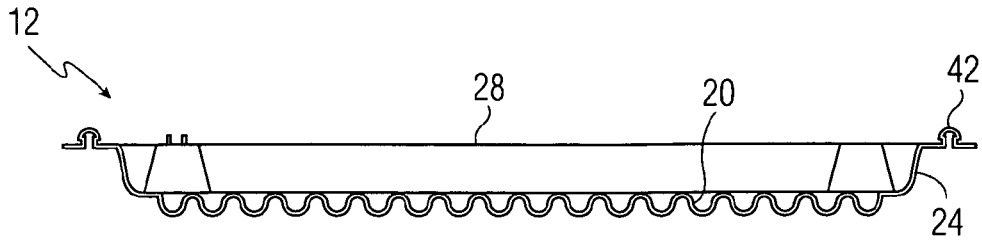
FIG. 6 is a cross-sectional view of the bottom section of the food container of FIG. 1.
Figure 7:
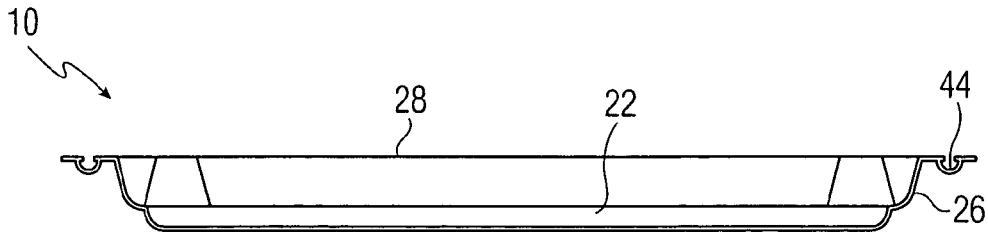
FIG. 7 is a cross-sectional view of the top section of the food container of FIG. 1.
Figure 8:
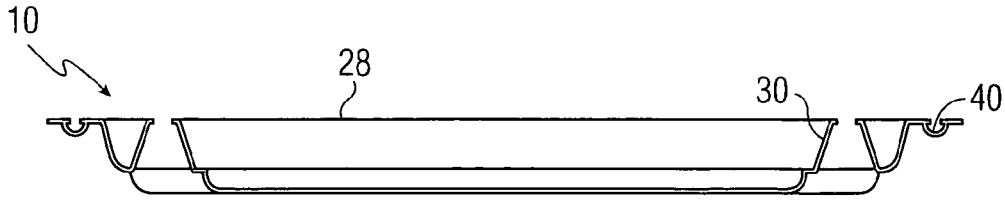
FIG. 8 is another cross-sectional view of the top section of the food container of FIG. 1, which extends through the chimneys.

As is best illustrated in FIG. 6, and in top view in FIG. 4, the base panel of at least the bottom section of the container—that is, the panel upon which the food item rests—is corrugated. These corrugations raise the food item away from the outside surface supporting the container and permit vapors, such as steam, to escape from the bottom of the food item to the interior of the container and, with sufficient pressure, through the vents and chimneys to the atmosphere.

Figure 15:
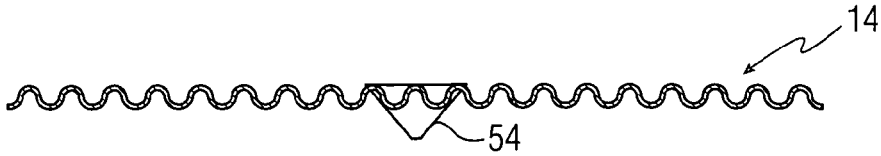
FIG. 15 is a side view of an insert section for the food container of FIG. 1.
Figure 16:
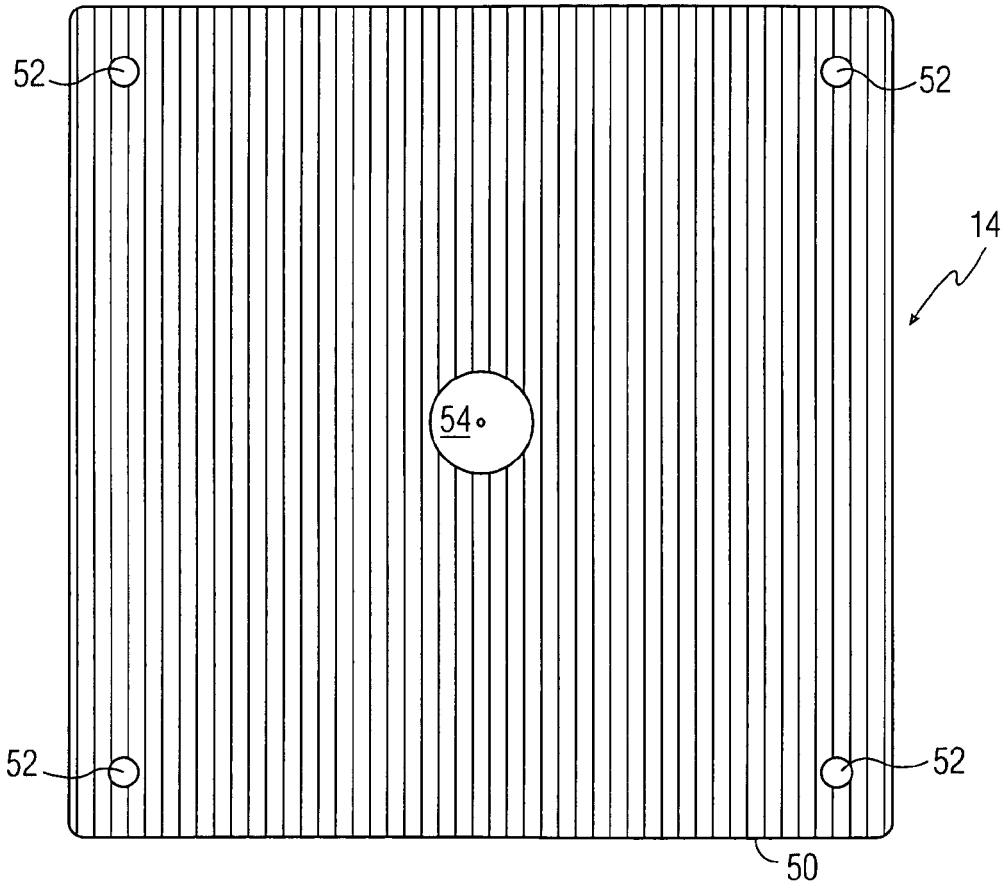
FIG. 16 is a top view of the insert section for the food container of FIG. 1.
Figure 17:
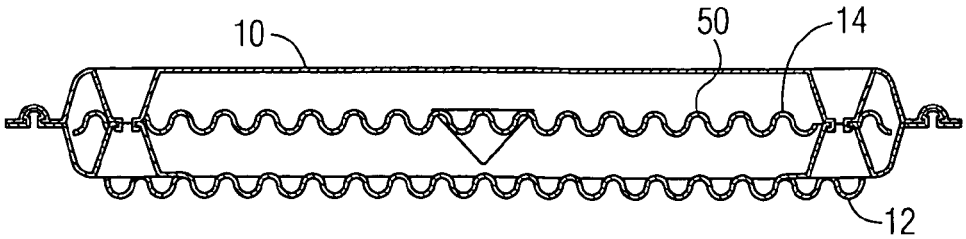
FIG. 17 is a cross-sectional view of the food container of FIG. 1 showing the insert section in place.

As noted above, an insert section 14 may be inserted between the top section 10 and the bottom section 12 of the container to form two compartments, as shown in cross section in FIG. 17. The insert section 14 may simply comprise a square corrugated sheet 50 with four openings 52 at its corners for the chimney flues. A central spindle 54, which is preferably cone shaped as shown in FIG. 15, may be provided to support the center of the insert section when it is placed in the container.

FIGS. 18-29 illustrate a second preferred embodiment of the present invention. This embodiment is very similar to the first embodiment shown in FIGS. 1-17 except that the top section 10 is integrally connected with the bottom section 12 along one edge or seam 60 to form a hinge. The two sections of the container, thus connected, form a "clamshell-like" container. In all other respects, however, this second embodiment is similar or identical to the first embodiment of the invention.

FIGS. 19-29 illustrate the various features of the container which correspond to the features of the first embodiment shown in FIGS. 2-14.

There has thus been shown and described a novel food container which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A disposable food delivery container comprising substantially similar upper and lower container sections which are shaped to co-operate and define an enclosure for receiving a food item to be delivered in the container, each of said sections comprising:

(a) a substantially square panel defining a base plane and having four lateral edges of substantially equal length and four corners;

(b) a sidewall formed integrally with said panel and extending along each lateral edge thereof at an angle with respect to said base plane, each sidewall being of substantially constant width and defining, together with the three other sidewalls, a plane of attachment to another container section, the sidewalls being adapted to mate with the corresponding sidewalls of said other container section at said plane of attachment;

(c) at least one chimney formed integrally with the said panel and extending outward from said base plane to said plane of attachment, each chimney being arranged adjacent one of the four corners and being adapted to mate with a corresponding chimney of said other container section at said plane of attachment, said chimney forming a flue for the passage of vapors and having at least one vent for allowing vapors to enter said flue from the container and dissipate in the atmosphere when vapor pressure inside the container exceeds a certain threshold above the atmospheric pressure.

2. The container recited in claim 1, wherein said vent in the chimney is a flap valve.

3. The container recited in claim 2, wherein said vent includes a circular membrane, supported at its periphery, which has a plurality of cuts extending from its center to its periphery.

4. The container recited in claim 3, wherein said vent includes six cuts spaced equidistantly apart and forming a 60 degree angle between them.

5. The container recited in claim 1, wherein each chimney on one container section includes means for connecting itself with a corresponding chimney of another container section, when said two sections are in mating relationship, while allowing vapors to pass between the two chimneys.

6. The container recited in claim 1, further comprising means arranged on said sidewalls of said sections for connecting one container section with said other container section, when the two sections are in mating relationship.

7. The container recited in claim 1, wherein the panel of at least one of said sections is corrugated so as to provide ventilation to a food item resting upon it.

8. The container recited in claim 7, wherein the corrugation has a design selected from the group consisting of parallel straight lines, alternative convex and concave dimples and concentric circles.

9. The container recited in claim 1, further comprising an insert section having a substantially square panel with four lateral edges each substantially equal in length to the length of the lateral edges of said panel, said insert section being adapted to be inserted between said container sections at said plane of attachment.

10. The container recited in claim 9, wherein the panel of the insert section is corrugated so as to provide ventilation to a food item resting upon it.

11. The container recited in claim 10, wherein the corrugation has a design selected from the group consisting of parallel straight lines, alternative convex and concave dimples and concentric circles.

12. The container recited in claim 9, wherein said insert section further comprises a downwardly depending spindle disposed at approximately the center of the panel thereof, for supporting the insert section at the middle when a food item is placed thereon.

13. The container recited in claim 12, wherein said spindle is cone-shaped with its apex pointing downward.

14. The container recited in claim 1, wherein said container sections are integrally connected together along one sidewall of each at said plane of attachment.

15. The container recited in claim 1, wherein said container sections are nestable, one immediately adjacent to the other.

16. The container recited in claim 1, wherein the sections of the container are made from a material selected from the group consisting of molded pulp paper, foamed plastic, unfoamed plastic, and polyethylene.

17. The container recited in claim 16, wherein the plastic is polystyrene.

* * * * *